US005388966A

United States Patent [19]

Bley

[11] Patent Number: 5,388,966

[45] Date of Patent: Feb. 14, 1995

[54] TOILET BOWL DRAINAGE DEVICE

[76] Inventor: John K. Bley, 185 Sherman, Montgomery, Ill. 60538

[21] Appl. No.: 133,998

[22] Filed: Oct. 12, 1993

[51] Int. Cl.[6] ..... F04B 17/00

[52] U.S. Cl. ..... 417/234; 417/411; 417/423.3; 4/661

[58] Field of Search ..... 417/411, 423.3, 423.14, 417/234; 4/661, 213

[56] References Cited

U.S. PATENT DOCUMENTS

| | | | |
|---|---|---|---|
| 2,492,141 | 12/1949 | Gaylord | 417/411 |
| 2,972,160 | 2/1961 | Hahn | 417/234 |
| 3,015,281 | 1/1962 | Umholtz | 417/234 |
| 3,195,148 | 7/1965 | Merkel | 417/411 |
| 3,647,323 | 3/1972 | Thomas | 417/411 |
| 3,910,725 | 10/1975 | Rule | 417/234 |
| 4,021,150 | 5/1977 | Mabuchi | 417/411 |
| 4,218,195 | 8/1980 | Shure | 417/411 |
| 4,502,515 | 3/1985 | Kobayashi et al. | 417/411 |
| 5,271,725 | 12/1993 | Freet et al. | 417/423.3 |

FOREIGN PATENT DOCUMENTS

| | | | |
|---|---|---|---|
| 911775 | 7/1946 | France | 417/423.3 |
| 563294 | 5/1957 | Italy | 417/234 |

*Primary Examiner*—Richard A. Berisch
*Assistant Examiner*—Peter Korytnyk
*Attorney, Agent, or Firm*—Kajane McManus

[57] ABSTRACT

The toilet bowl drainage pump includes an elongate housing having a curved forward end from which a length of tubing extends and in which a plurality of openings are cut at a larger diameter of the curve. A motorized impeller is seated within one chamber in the housing into which the openings lead and out of which the tubing leads. A power source for the motor is provided in a second isolated chamber is selectively operable to energize the pump. In use, the tubing is fed through and over a drain trap of the toilet bowl as the forward end of the housing is seated along a bottom-most surface of the bowl. The motor is then activated to pull water into the housing openings and eject the water throughout the tubing.

11 Claims, 1 Drawing Sheet

10
20
X
18
22
22
22
12
14
Y 20
18
62
X
52
72
10
50
12
56
16
22
58
60
22
22
Y
14
54

44
72
10
42
32
20
30
38
34
70
36
14
77

TOILET BOWL DRAINAGE DEVICE

BACKGROUND OF THE INVENTION

1. Field of the Invention

The present invention relates to a small, portable, hand held drainage device for use in flushing water from a toilet bowl when the water source for same cannot be accessed for shut off.

2. Description of the Prior Art

Heretofore various devices for draining water from an area to be dried have been proposed.

Sump pumps for removing water from a home or bilge pumps for removing water from a boat are well known in the art.

Examples of various water pumping devices may be found in the following US Patents:

| U.S. Pat. No. | Patentee |
|---|---|
| 2,492,141 | Gaylord |
| 4,021,150 | Mabuchi |
| 4,218,195 | Shure |

As will be described in greater detail hereinafter, the toilet bowl drainage device of the present invention fills a need in the janitorial maintenance field.

When cleaning out a toilet bowl or urinal in a large building, it is often impossible to access the source of water to shut same off. Cleaning of the toilet bowl or urinal requires the use of a chemical cleaning/disinfecting agent. When water is present in the bowl, dilution of the chemical is significant, requiring use of excessive amounts of the chemical.

If the bowl could be drained in a simple manner, lesser amounts of the chemical would be required.

Also, if the bowl or urinal would require service or repair, it would be advantageous to be able to drain same.

To be described hereinafter is a small hand pump having a configuration which will remove most, if not all, of the water from a toilet bowl or standing in a urinal and discharge same over a drain trap of the structure's plumbing.

SUMMARY OF THE INVENTION

According to the invention there is provided a pump for emptying water from a toilet or urinal bowl, by expelling the water into a drain of a toilet, the pump comprising a housing having curved forward end and a linear rear end, the forward having a nipple extending therefrom to which a predetermined length of tubing is engaged, the housing defining two isolated chambers therein, a first chamber being defined in the rear end of the housing and containing a selectively actuable source of power therein, a second chamber being defined in the forward end and having a motor operated impeller therein, the power source being selectively energizable to operate the motor to which the power source is engaged, the housing further including openings therein which lead into the second chamber, the openings lying along a largest in diameter curvature in the curved area of the housing, and the impeller acting to cause a flow of water into the chamber through the openings and out of the chamber through the tubing.

Further according to the invention there is provided a method for using the pump comprising the steps of snaking the tubing of the pump through and over the drain trap of the toilet bowl while lowering the forward end of the pump into the water; aligning the openings in the pump housing along a bottommost surface of the toilet bowl; and energizing the pump by activation of the motor power source.

DESCRIPTION OF THE PREFERRED EMBODIMENT

Figure 1:
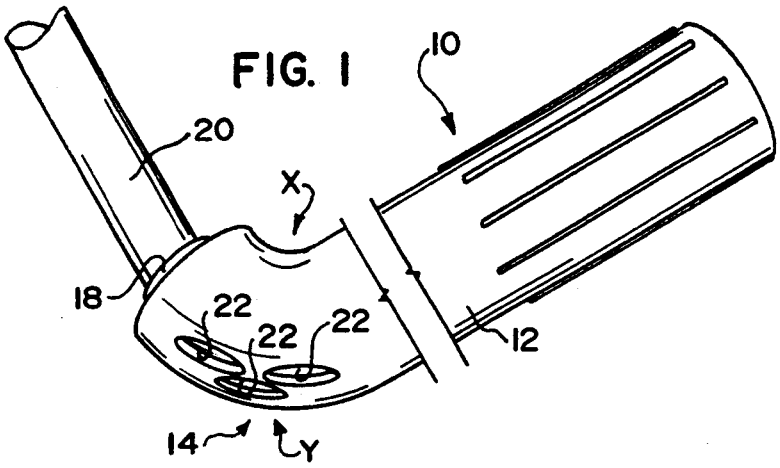
FIG. 1 is a perspective view of the pump of the present invention.
Figure 2:
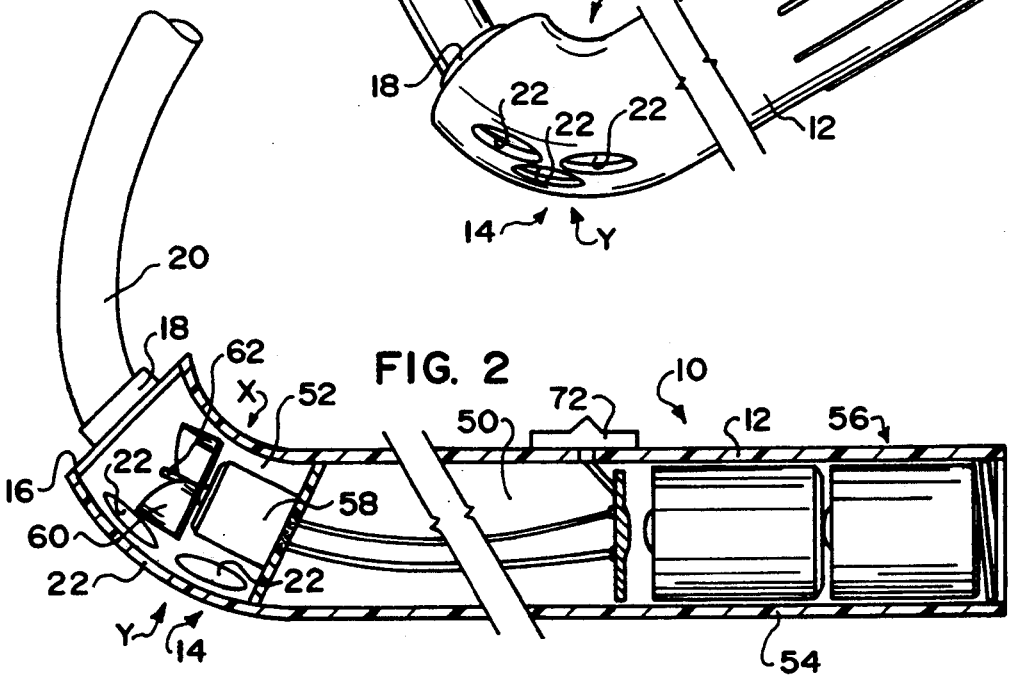
FIG. 2 is a longitudinal cross sectional view through the pump.
Figure 3:
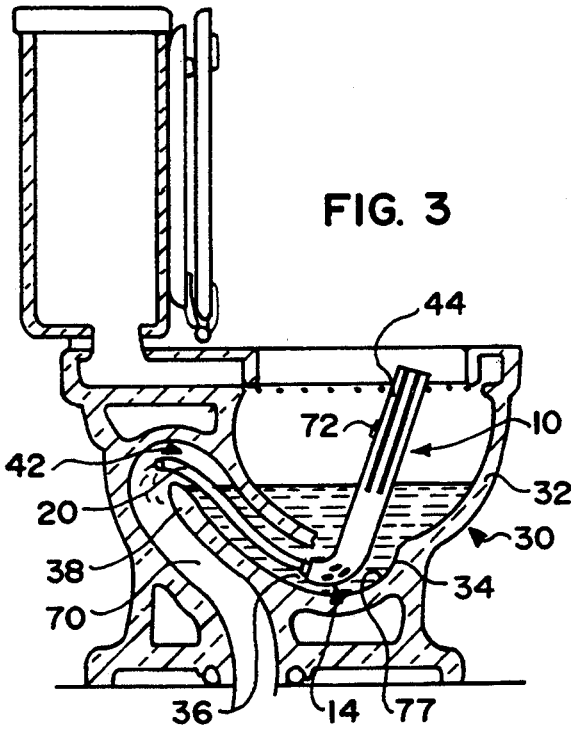
FIG. 3 shows the pump being used to drain a toilet bowl.

Referring now to the drawings in greater detail, there is illustrated therein a toilet bowl drainage pump made in accordance with the teachings of the present invention and generally identified by the reference numeral 10.

As shown, the pump 10 includes a housing 12 which has a somewhat J shaped configuration, having a curved forward end 14. An end wall 16 of the forward end 14 has a nipple 18 extending therefrom to which a tubing 20 is engageable.

The curved forward end 14 has an inner radius at X and a larger outer radius at Y. Cut into the housing 12 along and about the larger outer radius Y are a plurality of the openings 22.

Preferably, at least one of the openings 22 should lie along the line defining radius Y.

Such positioning of the openings 22 is necessary to accommodate near complete draining of a toilet bowl 30.

In this respect, the toilet bowl 30 includes a water basin 32 which narrows toward a lower end 34 thereof, the lower end 34 having a passage 36 therein which extends upwardly and rearwardly of the toilet bowl 30 to an area known as the drain trap 38 of the toilet 40. The mouth 42 of the drain trap 38 is positioned above the water level in the basin 32 so that the basin 32 only empties upon flushing.

To allow a user access to the drain trap 38 so that water in the bowl 32 can be pumped therepast, it is preferred to make the elongate tubing 20 at least fifteen to twenty inches in length.

Further, so that the user need not wet his hands or come into contact with water standing in the bowl 32 it is preferred that the pump housing 12 have an overall length of approximately twenty inches.

Still further, to be able to extend the curved forward end 14 of the housing 12 into the lowermost region 34 of the bowl 32, it is preferred to have a diameter of approximately one and one quarter inches.

Within the housing 12 are provided two chambers 50 and 52, each isolated from the other in a fluid tight manner.

The first chamber 50 extends upwardly into a handle forming portion 54 of the housing 12. Within this chamber 50 is seated a power pack 56 for the pump 10. The power pack 56 may comprise batteries or rechargeable electric cells.

This power pack 56 energizes a small DC motor 58 seated in the other chamber 52.

The DC motor 58 operatively engages an impeller 60 which is seated on a shaft 62 of the motor 58 and configured to direct a flow of water toward the end wall 16 of the chamber 52, and finally out through the nipple 18.

Obviously, when the impeller 60 is engaged and the pump 10 is placed within a volume of fluid, a suction is created within the chamber 52 which causes water to be pulled in through the openings 22 in the housing and then directed outwardly from the nipple 18, through the tubing 20 past the drain trap 38 and into the drain 70 of the toilet.

To produce a means for controlling activation of the impeller 60, a thumb slide switch 72 is provided on the housing 14, in a manner similar to that provided by a flashlight thumb switch.

The thumb switch 72 is positioned proximally along the handle forming portion 54 in a manner to be above the water level in the basin 32 at all times.

In use, the tubing 20 is snaked into the drain 70 past the drain trap 38, with the larger diameter curve Y of the housing forward end 14 being brought nearly flush with a bottommost surface 77 of the basin 32. The motor 58 is then energized by activation of the thumb switch 72 and water in the basin 32 is sucked into the openings 22 and expressed through the tubing 20 into the drain 70.

A nearly dry basin 32 can thus be provided for cleaning which significantly reduces the amount of cleaning chemicals required.

As described above, the pump 10 of the present invention provides a number of advantages, some of which have been described above and others of which are inherent. Accordingly the scope of the invention is only to be limited as necessitated by the accompanying claims.

I claim:

1. A portable, hand held pump for emptying water from a toilet or urinal bowl, by expelling the water into a drain of the toilet, the pump comprising a housing having curved forward end and linear rear end, the forward end having a nipple extending therefrom to which a predetermined length of tubing is engaged, the housing defining two isolated chambers therein, a first chamber being defined in the rear hand held end of the housing containing a selectively actuatable source of power therein, a second submersible chamber being defined in the forward end and having a motor operated impeller therein, the power source being selectively energizable to operate the motor to which the power source is engaged, the housing including openings therein which lead into the second chamber, the openings lying along a largest in diameter curvature in the curved area of the housing the impeller acting to cause a flow of water into the chamber via the openings and outwardly through the tubing.

2. The pump of claim 1 wherein the housing is approximately twenty inches long.

3. The pump of claim 2 wherein the housing has a diameter of approximately one and one quarter inches.

4. The pump of claim 3 wherein said source of power comprises batteries.

5. The pump of claim 3 wherein said source of power comprises rechargeable electric cells.

6. The pump of claim 3 wherein said motor is a DC motor.

7. The pump of claim 6 wherein a thumb slide switch is provided for controlling motor operation by intermittently engaging the power source.

8. The pump of claim 7 wherein a fluid tight seal is provided between the chambers.

9. The pump of claim 8 wherein at least one of the openings in the housing lies along the largest diameter line of curvature at the forward end of the housing.

10. The pump of claim 9 wherein the housing has a J shape.

11. A method of draining water from a toilet bowl using a pump comprising: a housing having curved forward end having a portable, hand held nipple extending therefrom to which a predetermined length of tubing is engaged, the housing defining two isolated chambers therein, a first chamber being defined in the rear hand held end of the housing containing a selectively actuable source of power therein, a second submersible chamber being defined in the forward end and having a motor operated impeller therein, the power source being selectively energizable to operate the motor to which the power source is engaged, the housing including openings therein which lead into the second chamber, the openings lying along a largest in diameter curvature in the curved area of the housing, the impeller acting to cause a flow of water into the chamber and out through the tubing, the method including the steps of:

snaking the tubing of the pump through and over the drain trap of the toilet bowl while lowering the forward end of the pump into the water;

aligning the openings in the pump housing along a bottommost surface the toilet bowl; and energizing the pump by activation of the motor power source.

* * * * *